US005776039A

United States Patent [19]

Perez, Jr.

[11] Patent Number: 5,776,039

[45] Date of Patent: Jul. 7, 1998

[54] EXERCISE APPARATUS

[75] Inventor: Charles B. Perez, Jr., Venice, Calif.

[73] Assignee: Dean G. Tornabene, Marina del Rey, Calif.

[21] Appl. No.: 172,492

[22] Filed: Dec. 23, 1993

[51] Int. Cl.[6] ..... A63B 21/08

[52] U.S. Cl. ..... 482/97; 482/121; 482/123

[58] Field of Search ..... 482/97, 124, 130, 482/100, 148, 908, 132, 133, 123

[56] References Cited

U.S. PATENT DOCUMENTS

| | | | |
|---|---|---|---|
| 1,703,104 | 2/1929 | Hassler | 482/97 |
| 3,345,067 | 10/1967 | Smith | 482/133 |
| 4,405,128 | 9/1983 | Mclaughlin | 482/97 |
| 4,411,421 | 10/1983 | Hershberger | 482/132 |
| 4,492,375 | 1/1985 | Connelly | 482/148 |
| 4,627,619 | 12/1986 | Rockwell et al. | 482/97 |
| 5,277,684 | 1/1994 | Harris | 482/908 |
| 5,300,005 | 4/1994 | Wang | 482/97 |
| 5,308,306 | 5/1994 | Wang | 482/142 |

FOREIGN PATENT DOCUMENTS

| | | | |
|---|---|---|---|
| 1674871 | 9/1991 | U.S.S.R. | 482/96 |

*Primary Examiner*—Jerome Donnelly

*Attorney, Agent, or Firm*—Howard A. Kenyon; Don A. Hollingsworth

[57] ABSTRACT

An exercise apparatus having a base, a first arm pivotable at one end thereof to the base, a second arm pivoted along its length to the other end of the first arm, and resilient means between the first and second arms, whereby relative movement of the arms is effected by the application of force reacting against the resistance of the resilient means. By the selection of the pivot points and simplified construction of the present invention, and the pivotal nature of the first arm relative to the base, the apparatus is easily foldable to a collapsed condition for easy storage and transportation. In operation, the first arm may be prevented from pivoting by the insertion of a pin through mating holes between the first arm and the base, and when the pin is removed, the first arm is pivotable to a position adjacent the base, so that the entire unit has a thickness, in its folded state, of approximately the thickness of the two arms and base member.

3 Claims, 4 Drawing Sheets

EXERCISE APPARATUS

BACKGROUND OF THE INVENTION

1. Field of the Invention

This invention relates to the field of exercise apparatus, and in particular to an apparatus which can be simply arranged in different configurations in order that the user can work different muscle groups at a variety of strength levels, and which can be folded into a compact and easily transportable and storable unit.

2. Brief Description of the Prior Art

Prior art exercise equipment falls into two basic categories, permanently installed more industrial type equipment, and simple exercise equipment for the home user. Some prior art exercise equipment which appear to fall into the home equipment category include U.S. Pat. No. 4,521,013 to Dofel which discloses an exercising device including a base, a post fixed to the base in a non-pivoting manner, and an operating lever 35 which is not pivotal at the free end of the upstanding post. The device further includes a separate complex resistance element employing a number of pulleys and multiple strands of a long cable. The device is not easily disassembled and is not readily adapted to be folded into a collapsed condition.

U.S. Pat. No. 4,618,144 to Gibson illustrates a self-contained hand transportable portable exercise device employing a tension biasing loop or spring as a resistance element. Although the device is foldable, it consists of a significant number of support arms, levers, posts, and the like which makes it appear to be extremely difficult to collapse into a storable or transportable condition. One of the reasons for the complexity is that the Gibson exercise device includes, as part of its construction, a bench 14 and a bench extension 16, both supported by legs 24, 26, and 48. As with the Dofel device, the operating lever of Gibson is pivotally mounted on an upstanding post near its central region.

U.S. Pat. No. 4,809,979 to Berger describes an apparatus for exercising the arms and legs, somewhat in the form of a rowing machine. This device is not adapted for a variety of different exercises to be performed and is not collapsible into a compact form.

U.S. Pat. No. 5,094,450 to Stearns illustrates an abdominal exercise machine which has a base and an upstanding post at the top of which is a seat for the user to sit on while exercising his or her abdominal muscles against a chest pad which rotates in a circular arc about a center of rotation located above the seat. A variety of resistance mechanisms are illustrated, but the system is not collapsible and is restricted in the number of muscle groups it can exercise.

U.S. Pat. No. 5,112,287 to Brewer shows an exercising device which has a stool-like base portion with vertical support members, and tension members releasibly attached to the base and to a selected receiving member, such as a crossbar. While the exercising device of Brewer is simple, it is not adapted to be collapsed for easy storage and transportation, and has no pivoting operating lever, since the exercise bar, or other implement grasped by the user, is attached to the base portion solely by the elastic tension members.

It can therefore be appreciated that, especially for home use, there is a need in this field of art for a simplified exercising apparatus which can exercise a number of different muscle groups at a variety of selected strengths, and yet which is foldable and collapsible to an easily transportable or storable unit. The present invention fulfills those objectives.

SUMMARY OF THE INVENTION

The present invention overcomes all of the shortcomings of the prior art mentioned above by providing an exercise apparatus comprising a base, a first arm pivotable at one end thereof to the base, a second arm pivoted along its length to the other end of the first arm, and resilient means between the first and second arms, whereby relative movement of the arms is effected by the application of force reacting against the resistance of the resilient means. By the selection of the pivot points and simplified construction of the present invention, and the pivotal nature of the first arm relative to the base, the apparatus is easily foldable to a collapsed condition for easy storage and transportation. In operation, the first arm may be prevented from pivoting by the insertion of a pin through mating holes between the first arm and the base, and when the pin is removed, the first arm is pivotable to a position adjacent the base, so that the entire unit has a thickness, in its folded state, of approximately the thickness of the two arms and base member, i.e. of about five inches.

More specifically, the exercise apparatus may comprise a base member, a first rigid arm having a lower end secured to the base and an upper end. An elongated second rigid arm is provided with first and second ends and has a pivot means fixed intermediate the first and second ends for pivotally mounting the second arm on the upper end of the first arm. Resilient means are then coupled between the first arm at a location between its lower and upper ends, and the second arm at a location spaced from the pivot means. In this manner, an exercise is carried out by pivoting the second arm about the pivot means in one direction against the resiliency of the resilient means.

Preferably, the second arm includes means for selectively attaching the resilient means to one of at least two locations, one of the locations being on one side of the pivot means, and the other of the locations being on the other side of the pivot means. In this way, the exercise is carried out by pivoting the second arm about the pivot means in one direction when the resilient means is attached at the one location, and the exercise is carried out by pivoting the second arm about the pivot means in the opposite direction when the resilient means is attached at the other location.

In a preferred embodiment, the exercise apparatus includes a third rigid arm, similar to the first arm, and an elongated fourth rigid arm, similar to the second arm, whereby the first and third arms are maintained parallel to each other at all times and at all operating conditions of the exercise apparatus, and the second and fourth arms are maintained parallel to each other at all times and at all operating conditions of the exercise apparatus. A crossbar joins one end, hereinafter referred to as the free end, of each of the second and fourth rigid arms, and a pad is located along the crossbar for the users comfort. Also for the user's comfort, the base member may comprise a cushion.

BRIEF DESCRIPTION OF THE DRAWING

The invention will now be described with reference to the accompanying drawings showing a preferred form of the present invention by way of example. In the drawings.

DETAILED DESCRIPTION OF THE PREFERRED EMBODIMENTS

Figure 1:
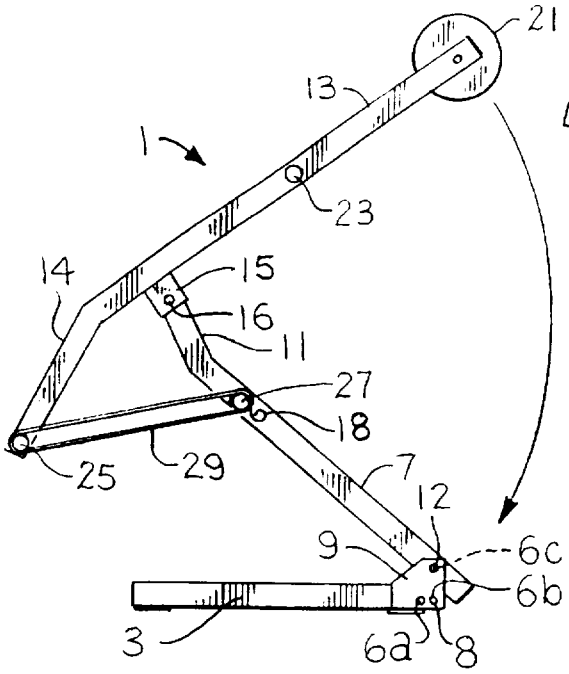
FIG. 1 shows an arrangement of the present invention in which the resilient means is attached between the two arms of the device to provide resistance to a downward movement by the user at the free end of the second arm.
Figure 2:
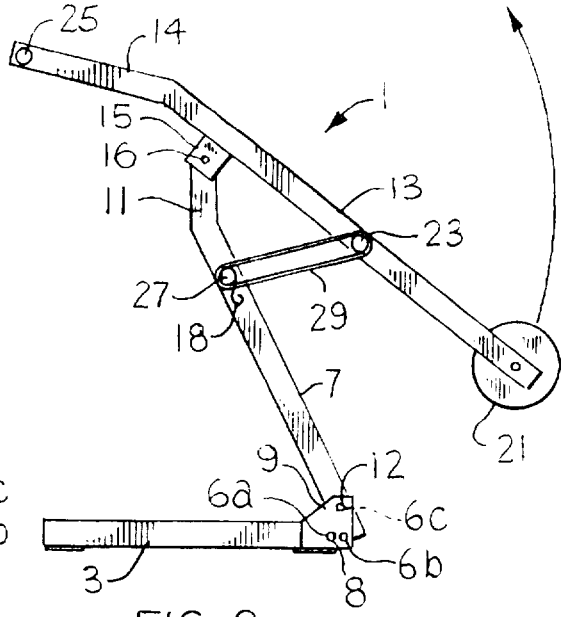
FIG. 2 shows an alternative arrangement of the resilient means connected between the two arms, whereby the user must exert an upwardly directed force on the free end of the second arm to overcome the resistance of the resilient means.
Figure 3:
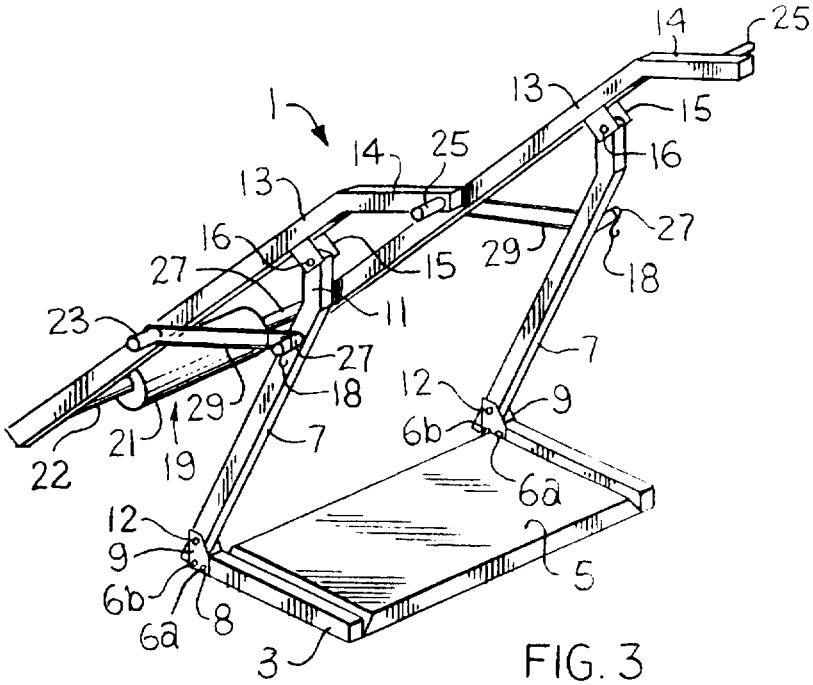
FIG. 3 is a perspective view of a preferred embodiment of the invention showing parallel pairs of arms arranged in the configuration shown in FIG. 2.
Figure 4:
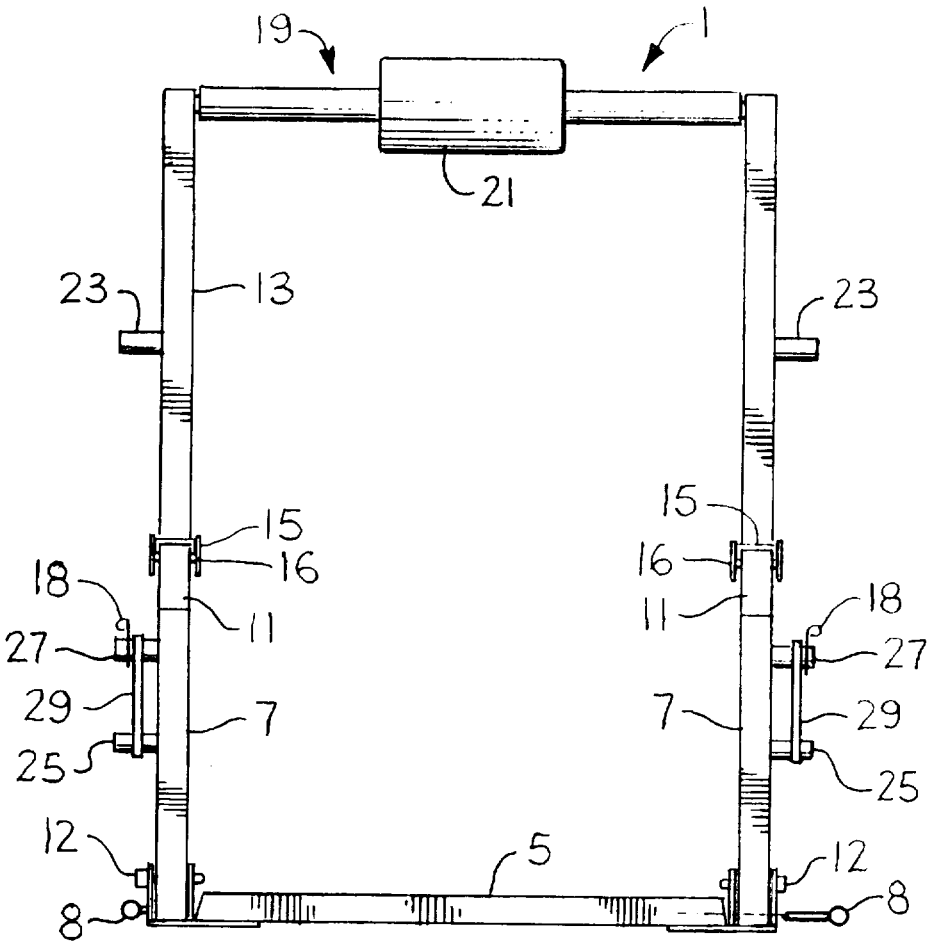
FIG. 4 is a front elevation view of the arrangement of the exercise apparatus shown in FIG. 1.

FIGS. 1–4 show the invention in the setup condition, ready for use. FIGS. 1, 3, and 4 show the exercise apparatus 1 configured to resist a downwardly applied force by the user to exercise such muscle groups as biceps, triceps, chest, back, rear shoulders, abdominals, inner thigh, and neck. FIG. 2 shows a reconfiguration of the exercise apparatus 1 in which an exercise is carried out by the application by the user of an upwardly directed force to exercise such muscle groups as biceps, triceps, chest, back, shoulders, trapezius, outer thigh, gluteus maximus, calves, front thigh, rear thigh, lower back, and forearms.

With particular reference to FIGS. 1, 3, and 4, the exercise apparatus 1 comprises a base member 3 either having a cushion top 5 or covered by a padded cushion 5 to provide a comfortable area for the user to sit, lie, stand, or kneel while performing exercises using the invention. On the front of base member 3 is permanently mounted a support bracket 9, having a pair of latch pin holes 6*a* and 6*b* and a third hole 6*c* through which a pivot bolt 12 may be inserted for pivotally mounting a first/support arm 7 to the support bracket 9. A latch pin 8 may be of a preferred type in which a spring loaded ball is depressed as latch pin 8 is inserted, and released after full insertion to retain the latch pin in place.

Figure 7:
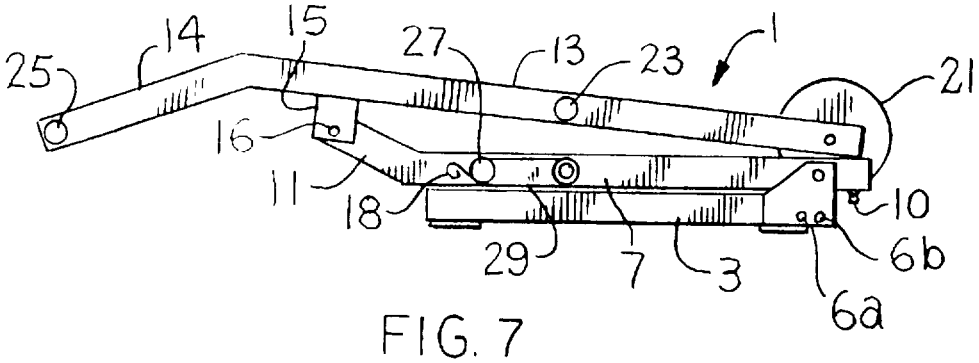
FIG. 7 is a side view of the folded, collapsed exercise apparatus shown in FIG. 5.

As best seen in FIG. 7, a latch pin receiver tube 10 is attached to the bottom of support arm 7 and may be aligned with latch pin holes 6*a* or 6*b*, depending upon the position of support arm 7 as it is pivoted about pivot bolt 12. In FIG. 1, latch pin 8 is shown to be inserted through latch pin hole 6*b* and into the aligned latch pin receiving tube 10 (FIG. 7) attached to the bottom of support arm 7. As shown in FIG. 1, this makes the angle between support arm 7 and base member 3 to be in the vicinity of 40 to 55 degrees. Upon removal of latch pin 8 from hole 6*b*, support arm 7 may be rotated clockwise (with reference to FIG. 1), toward the front of the unit, and latch pin 8 can be reinserted into latch pin hole 6*a* and through latch pin receiver tube 10 (FIG. 7) in order to fix support arm 7 at a larger angle relative to the base member 3 of approximately 55 to 70 degrees. It is to be understood that the angles shown in the drawing and mentioned in this description are merely examples of preferred angles of configuration, and any other angle outside the ranges given can be advantageously employed simply by relocating latch pin holes 6*a* and 6*b*, adding new latch pin holes in bracket 9, relocating the latch pin receiver tube 10, etc. without departing from the adjustable angle concept being advanced.

With support arm 7 latched at one of its fixed positions relative to base member 3, support arm 7 is in a condition to support a second/operating arm 13 pivotally mounted at the top of support arm 7 by means of a U-shaped coupler 15 attached to the underside of operating arm 13 and pivotally mounted to the top of support arm 7 by a pivot bolt 16 passing through both U-shaped coupler 15 and the top end of su pport arm 7.

Support arm 7 includes a bent end 11 which extends substantially vertically in order to support the operating arm 13 for pivotal movement in a wide range of movement angles about support arm 7.

Operating arm 13 has a body contact protector/grip 21 on its free end, an end projecting pin 25 on its opposite end, and an intermediate projecting pin 23 intermediate its ends. A reference projecting pin 27 is fixed to support arm 7, and a resilient member 29 is shown in FIG. 1 to be attached between reference pin 27 and end pin 25. Resilient member 29 is preferably a resilient rubber band, spring, or loop and may be coupled between reference pin 27 and end pin 25, such that when the body contact protector 21 is moved downwardly in the direction of the arrow shown in FIG. 1, band 29 is stretched by the upward movement of pin 25 relative to the fixed reference pin 27. As the free end of operating arm 13 continues to move downwardly, the central axis of band 29, which passes through reference pin 27 and end pin 25, moves closer to the pivot point at the pivot bolt 16. Since the band stretches because of such movement, it can be mathematically analyzed that the moment arm about pivot bolt 16 continually decreases as band 29 moves closer to pivot bolt 16, so that the user experiences an initial increase in resistance by the band 29 followed by a diminishing of the resistance force of band 29 as the free end of operating arm 13 continues to move through its full arc of movement. This is advantageous from the viewpoint that, for fitness conditioning, it is generally recommended that the force applied by the muscles being exercised be smaller at the beginning of the exercise movement, increase to a maximum during the exercise movement, and diminish at the end of the exercise movement. Since the resilient/resistance strength of band 29 increases as it is stretched, the initial force required to move operating arm 13 at the beginning of its stroke is less than that when the band becomes further stretched, so that the beginning of the movement cycle requires less applied force by the user. As the band 29 stretches, its resistance increases, and the force applied by the user to continue movement of operating arm 13 through its full cycle likewise increases, as is desired. Then, as the axis of band 29 moves closer to pivot bolt 16, as explained earlier, the moment arm about bolt 16 reduces and more than offsets the increase in resistance offered by the stretching of band 29, such that the net force needed to be applied by the user at the end of the movement cycle is reduced. This action, then, produces the desirable results that the force to be applied by the user is less at the beginning of the movement cycle, increases to a maximum during the movement cycle, and is reduced again at the end of the movement cycle.

Operating arm 13 has a bent end 14 which enhances the characteristics described in the previous paragraph. That is, by bending operating arm 13 downwardly, end pin 25 is brought closer to the pivot bolt 16 sooner than it would if the end of operating arm 13 was straight. By choosing the characteristics of the band 29, the positions of projecting pins 23, 25, 27, and the proper bend angle for bent end 14 and bent end 11 of support arm 7, a predetermined applied-force profile can be generated.

In the embodiment of FIG. 2, where the body contact protector 21 is in the lowered position, the user usually needs to place his or her body on the cushion 5, but the protector 21 in the way. To avoid this problem, the movement of operating arm 13 all the way to the top causes the axis of resilient member 29 to pass by the axis of pivot bolt 16 and thereby force operating arm 13 to be biased further forwardly until arm 13 stops against arm 7. This action holds arm 13 in a latched condition until the user is in position. Then, a slight pull on the protector 21 will move arm 13 downwardly into exercise position. All of projecting pins 23, 25, and 27 are of sufficient length to accommodate a number of bands 29 so that different combinations of bands can provide a wide range of resistance levels. Since all bands 29 will be attached to reference pin 27 for all configurations of the exercise apparatus 1, a keeper spring 18 may be slipped over the end of reference pin 27 after the number of bands 29 are in place, reference pin 27 thereby providing a convenient storage location for the bands 29 so that they do not get lost during operation, storage, or transportation of the exercise apparatus.

In FIG. 2, the operating arm 13 is rotated so that the body contact protector 21 begins at the lowest point in its movement cycle, and band or bands 29 are extended between reference pin 27 and intermediate projecting pin 23. The same physical principles are involved in the movement of body contact protector/grip 21 upwardly as was the case during a downward movement explained in connection with FIG. 1, insofar as the applied-force profile for the user is concerned. That is, at the beginning of the upward movement of the free end of operating bar 13 as shown in FIG. 2, the resistance of band 29 is minimum. The resistance force increases as band 29 stretches, and finally the net result of the combination of increased band resistance and decreased moment arm component due to the movement of band 29 closer to pivot bolt 16, the force at the end of the movement cycle is reduced.

The invention has been described so far with a description of a base member 3, a single support arm 7, a single operating arm 13, and one or more interconnecting bands 29. It is conceivable, of course, that a configuration with only a single pair of arms 7, 13 can be configured. This would, of course, require the body contact protector/grip 21 to be T-shaped (not shown), however. In FIGS. 3 and 4, it can be appreciated that the preferred embodiment of the invention requires a pair of parallel support arms 7 and a similar pair of parallel operating arms 13 with a crossbar 19 extending between the free ends of operating arms 13. Body contact protector 21 is shown in FIGS. 3 and 4 as a large diameter soft cushion for making contact with the user's leg or chest when operating the exercise apparatus, while a pair of smaller diameter hand grips 22 are provided on either side of protector 21 to be grasped by the user for exercising arm and chest muscles.

Figure 5:
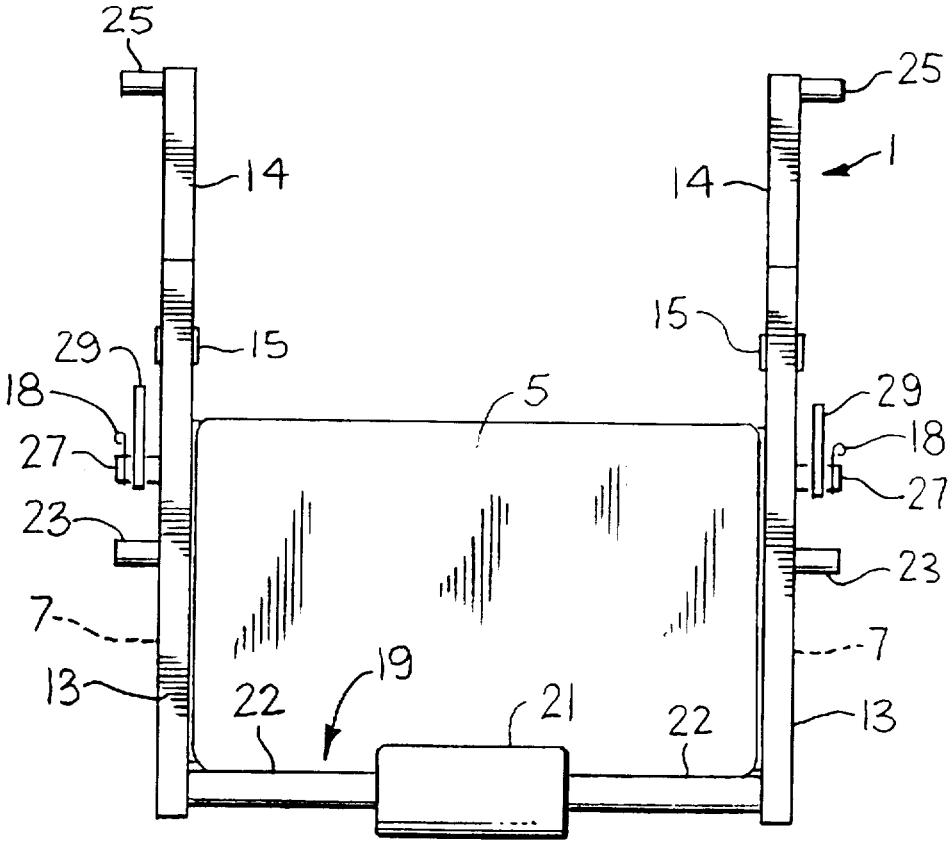
FIG. 5 is a top plan view of the exercise apparatus in its folded, collapsed state.
Figure 6:
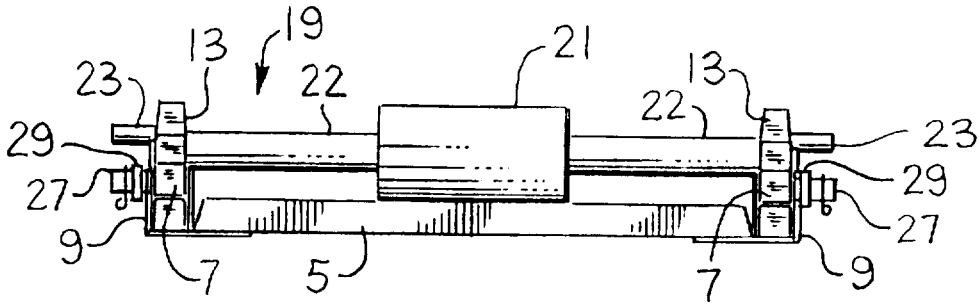
FIG. 6 is an end view of the folded, collapsed exercise apparatus shown in FIG. 5.

One unique advantage of the present invention, in addition to the ability to provide a variety of angles, movement cycles, resistance levels, directional changes of applied force, etc., is that the exercise apparatus 1 is completely foldable so as to collapse into a low profile for storage under a bed, in a trunk, on the back of a bicycle, or simply for being transported by hand either in or out of a carrying bag. FIGS. 5–7 illustrate this important feature of the invention.

In FIG. 5, a top plan view of the folded apparatus of FIGS. 3 and 4 is shown. FIG. 6 shows a front view of the folded apparatus, and FIG. 7 shows a side view thereof. In order to fold the exercise apparatus 1, latch pins 8 are removed from latch pin holes 6*a* or 6*b*, thereby permitting supports arm 7 to be pivoted about pivot bolts 12 and collapsed to lie flat against the side of or frame of base member 3. With all resilient members 29 removed from either intermediate projecting pins 23 or end projecting pins, operating arms 13 are free to pivot about bolts 16 to lie against support arms 7 in the manner shown in FIGS. 6 and 7. The entire unit can then be easily transported or stored in a minimal height storage facility.

Figure 8:
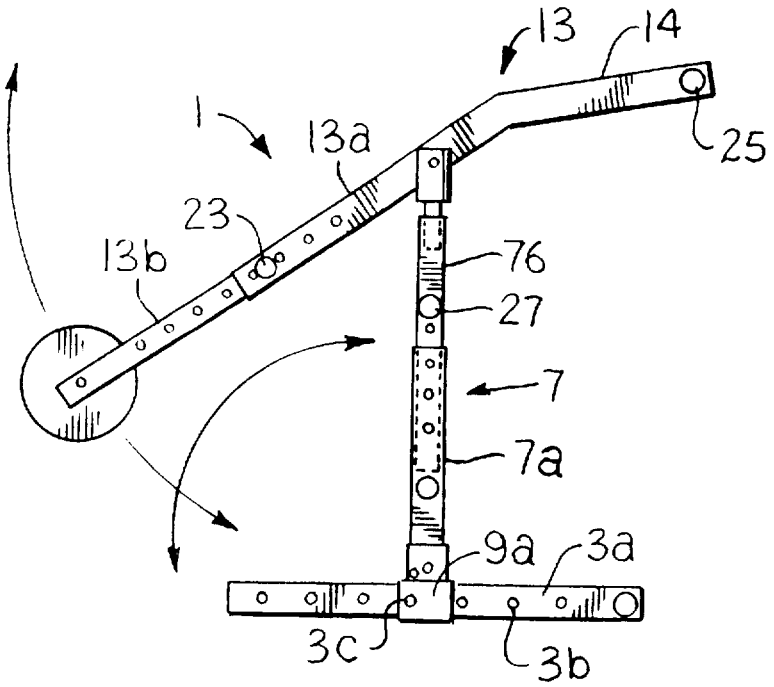
FIG. 8 shows a modification of the basic exercise apparatus in which the lengths of the arms and location of base attachment are adjustable.

FIG. 8 illustrates an improvement in the basic invention, whereby support arm 7 and operating arm 13 are each configured as telescoping units having, respectively, outer and inner telescoping members 7*a*, 7*b* and 13*a*, 13*b*. Any common means of locking telescoping members together can be employed to fix the length of the respective arms at any desired length. A base member 3*a* with indexing holes 3*b* to match any of similar indexing holes 3*c* on a modified support bracket 9*a* permits adjustment of the anchored position of support arm 7 to various locations, forward and back, relative to base member 3.

The invention can be made of a number of materials, although it is a goal of the invention to provide a light weight unit. Therefore, although any number of metals could be used to form the base member 3, support arms 7, and operating arms 13, the preferred metal is aluminum, and, of course, plastic materials, such as polyurethane, can be employed in the manufacture of the product. The cushion 5 may be wrapped about base member 3 entirely so that a foam center provides a soft location for the user's body.

Although the invention has been described showing resilient members 29 as a rubber band, a tension spring could be substituted for the rubber bands, or even free weights could be hung on intermediate pins 23 or end projecting pins 25.

The base member is preferably about 12 inches by 22 inches in size, and the height of the exercise apparatus 1 from the base member 3 to the top of support arm 7 is preferably in the range of 16 to 18 inches. The length of operating arm 13 is approximately 28 to 30 inches, and the weight of the entire assembled unit is in the range of 8 to 12 pounds. The telescoping operating arm range is preferably from about 24 inches to 32 inches, while the telescoping range for the length of support arm 7 is approximately 14 inches to 20 inches.

The present invention has been described with particular reference to the specific embodiments shown in the drawing. After revealing the invention and the concepts shown and described, it will be apparent to one skilled in the art that certain modifications can be made to configure other embodiments of the invention without departing from the spirit and scope of the inventive exercise apparatus particularly shown and described herein. Accordingly, the invention is not to be limited by the specific embodiments shown and described, but rather by the scope of the appended claims.

I claim:

1. An exercise apparatus comprising:

a base member having a cushion;

a first rigid arm having a lower end secured to said base member and an upper end;

an elongated second rigid arm with first and second ends, said second rigid arm pivotally mounted on said upper end of said first arm intermediate said first and second ends;

pivotally mounting said second arm on said upper end of said first arm;

resilient means coupled between said first arm at a location between said lower and upper ends, and said second arm at a location spaced from said pivot means;

said second arm includes means for selective attachment of said resilient means to one of at least two locations, one of said locations being on one said of said pivot means, and another of said locations being on the other side of said pivot means;

an exercise being performed by pivoting said second arm about said pivot means in said one direction when said resilient means is attached at said one location, and an exercise being performed by pivoting said second arm about said pivot means in the opposite direction when said resilient means is attached at said other location;

said first arm being releasably secured to said base member, and upon release of such securement and removal of at least one attachment point of said resilient means, said base member, said first arm, and said second arm collapse to a folded condition.

2. An apparatus as described in claim 1 further comprising:

a third rigid arm, similar to said first arm, having a lower end secured to said base member and upper end;

an elongated forth rigid arm, similar to said second arm, with first and second ends;

a second pivot means fixed intermediate, said first and second ends of said fourth arm for pivotally mounting said fourth arm on said upper end of said third arm;

a second resilient means coupled between said third arm at a location between said lower and upper ends thereof, and said fourth arm at a location spaced from said second pivot means;

said second arm including means for selective attachment of said resilient means to one of at least two locations, one of said locations being on one said of said pivot means, and another of said locations being on the other said of said pivot means;

said exercise being carried out by pivoting said second arm about said pivot means in said one direction when said resilient means is attached at said one location, and said exercise is performed by pivoting said second arm about said pivot means in the opposite direction when said resilient means is attached at said other location;

said first and third arms being maintained parallel to each other at all times and at all operating conditions of said exercise apparatus, and said second and fourth arms being maintained parallel to each other at all times and at all operating conditions of said exercise apparatus;

a cross bar joining said second ends of said second and fourth rigid arms;

a pad located along said cross bar;

said first, second, third and fourth arms being provided with projections extending therefrom in directions parallel to the axis of pivoting of said second and fourth arms;

said resilient means comprising expandable bands selectively coupled between said first and said second arms and said third and fourth arms by means of attachment to said projections.

3. The apparatus as described in claim 1 further comprising:

said first and third arms define a pair of arms, said second and fourth arms define another pair of arms, and at least one pair of said arms is extendible to adjust the pair length;

a pin and hole arrangement for securing said first arm to said base member when said pin is in said hole, and for releasing the securement when said pin is pulled out of said hole, thereby allowing said first arm to fold against said base member, said second arm being pivotable about said pivot means to fold against said folded first arm;

a pin and hole arrangement for securing each of said first and third arms to said base member when a respective pin is in its hole, and for releasing the securement when the respective pin is pulled out of said hole, thereby allowing said first and third arms to fold against said base member, said second and fourth arms being pivotable, respectively, about said pivot means and said second pivot means to fold, respectively, against said folded first and third arms.

* * * * *